US006364216B1

(12) United States Patent
Martin

(10) Patent No.: US 6,364,216 B1
(45) Date of Patent: Apr. 2, 2002

(54) UNIVERSAL POWER CONNECTOR FOR JOINING FLEXIBLE CABLES TO RIGID DEVICES IN ANY OF MANY CONFIGURATIONS

(75) Inventor: Donald R. Martin, New Lenox, IL (US)

(73) Assignee: G&W Electric Co., Blue Island, IL (US)

( * ) Notice: Subject to any disclaimer, the term of this patent is extended or adjusted under 35 U.S.C. 154(b) by 0 days.

(21) Appl. No.: 09/788,877

(22) Filed: Feb. 20, 2001

(51) Int. Cl.[7] ..... H01R 13/53
(52) U.S. Cl. ..... 239/181; 439/921
(58) Field of Search ..... 439/181, 183, 439/801, 921, 507

(56) References Cited

U.S. PATENT DOCUMENTS 4,059,326 A * 11/1977 Ouelette et al. ..... 439/281
4,799,895 A * 1/1989 Borgstrom ..... 439/183
4,857,021 A * 8/1989 Boliver et al. ..... 439/801
4,865,559 A * 9/1989 Clabburn ..... 439/281
4,955,823 A * 9/1990 Luzzi ..... 439/507
5,857,862 A * 1/1999 Muench et al. ..... 439/181

* cited by examiner

*Primary Examiner*—Tulsidas Patel
(74) *Attorney, Agent, or Firm*—Michael Best & Friedrich LLC; Martin L. Stern

(57) ABSTRACT

A connector having an elongated, multi-chamber, corrosion resistant, insulating, plastic housing provides for connecting a flexible power cable to equipment associated with a fixed device. One end of the housing is bolted to the fixed device. The opposite end and a central location of the housing have entrances for receiving bushings that may have a flexible power cable connected thereto. A floating adapter bushing is located between the busing and a recess in order to accommodate thermal expansion and contraction which may occur between equipment carrying the adapter and recess. The housing may include a vacuum interrupter or other suitable device. A plurality of the housings may be stacked together in order to provide for making combinations of selected parts and cables on a basis of unique requirements at a specific location.

22 Claims, 5 Drawing Sheets

UNIVERSAL POWER CONNECTOR FOR JOINING FLEXIBLE CABLES TO RIGID DEVICES IN ANY OF MANY CONFIGURATIONS

BACKGROUND OF THE INVENTION

This invention relates to connector means for making flexible to rigid connections in the electrical power distribution field, and more particularly to universal means for making such connections in any of many different configurations and with any of many different components.

Reference is made to U.S. Pat. No. 3,961,127 as an example of prior art power line connectors. While this type of connector functions very well, it has inherent limitations which give it a less than universal application. First, all of the connected cables are flexible so that the connector joint is not fully supported. The complete flexibility is provided to overcome problems relating to failures caused by cumulative mechanical tolerances. In an extreme case, these cumulative contractions during wide temperature changes might cause a connector to pull a plug out of a socket.

A second problem is that the prior art connectors required them to be made in specific configurations commonly called "WYE", "TEE", or "H" joints. This requirement to use "specific configurations" inherently limits options and sometimes tends to produce awkward connections.

Yet another problem with using fully flexible joints leads to a need to make specific types of splices and to use specific clamping devices, rather than a more convenient splice or clamp, for a specific use.

All of these and similar limitations in the prior art tended to produce conditions that might lead to an electrical breakdown, interruption, or a complete failure.

BRIEF DESCRIPTION OF THE INVENTION

Accordingly, there is a need for a universal connector which may couple flexible power cables to rigidly mounted devices. The connector should accommodate almost any appropriate device such as: switches, transformers, fuses, transducers, and the like, that may be used with the connector. It should be usable in different configurations.

In keeping with an aspect of the invention, a rigid, molded, plastic housing may surround and contain a central conductor, device, or the like, which may carry a high voltage, electrical, power current. The housing has a plurality of entrances providing access for power cables. Each entrance has two mating components separated by a non-conductive elastomeric gasket. When the mating components are joined with a suitable clamping force, there is a controlled compression of the elastomeric gasket which both seals the housing against an invasive environment and provides dielectric withstand capabilities. In one, particularly useful embodiment, the housing contains a vacuum interrupter which may be controlled by a movable driving rod.

BRIEF DESCRIPTION OF THE DRAWINGS

The invention may be best understood by the following specification taken with the attached drawings, in which.

DETAILED DESCRIPTION OF THE INVENTION

Figures 1, 2:
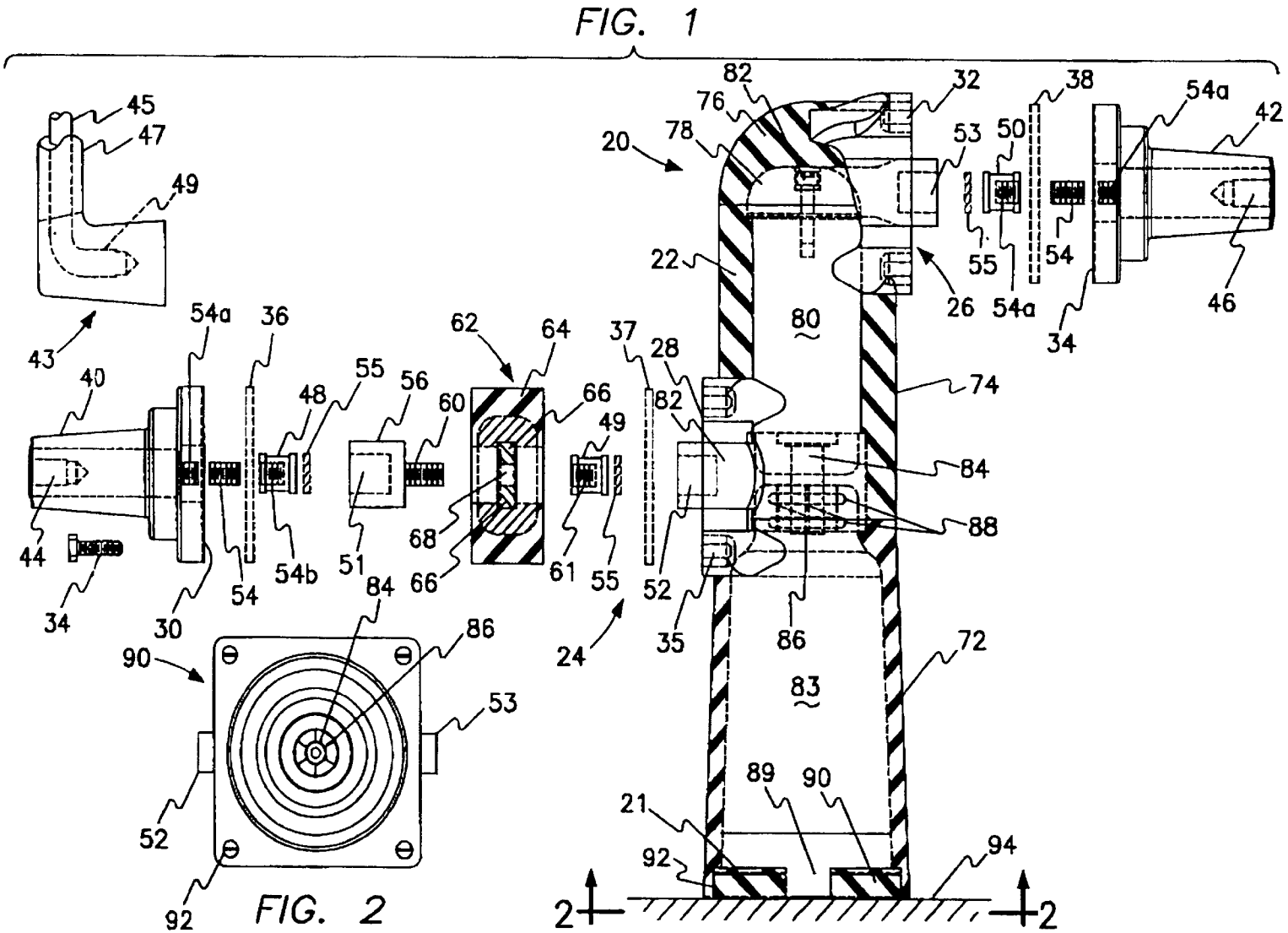
FIG. 1 is an exploded view of the inventive connector.
FIG. 2 is a bottom plan view taken along line 2—2 of FIG. 1.

FIG. 1 shows an exemplary exploded view of the inventive connector 20, here the connector being shown as an empty housing. The housing has an outer body 22 which may be made of any suitable, corrosion resistant material such as epoxy resin. The housing has two chambers. As here shown, there is an open proximal end 21 and two entrances 24, 26 to the housing which are remote from the open end, there being an entrance to each of the chambers in the housing. Each housing entrance has two mating, flat surfaced components 28, 30 and 32, 33, respectively, which may be bolted together. The housing may be either molded over a collection of parts after they are assembled or molded first and then have the parts inserted therein.

In each entrance, one or more elastomeric gaskets 36, 37 38 are positioned between the flat surfaces 28, 30 and 32, 33, respectively. When the flat surfaces are bolted together, the associated elastomeric gasket or gaskets 36–38 receive a controlled amount of compression at the interface of the two confronting surfaces in order to seal the entrances 24, 26 and prevent an invasion of unwanted environmental matter, such as moisture, dust, etc. Also, the gaskets provide a dielectric withstand capability between the central conductors 56, 82, etc. which are at an elevated potential and the outer surface which is at ground potential.

In this example, the adapter bushing members 40 and 42 are provided at housing entrances 24, 26 for making an electrical connection by a suitable, commercially available connector 43 designed to plug into jacks 44, 46. These connectors have an elastomeric elbow 47 on the end of a power cable which carries a wire 45 down the middle of the cable and elbow. The elbow slips over the exterior surface of adapter bushing 40 or 42 while a plug 49 on the end of the wire 45 slips into opening 44 or 46 in the bushing.

Separate multi-contact, bridging adapters 48, 49, 50 slidingly fit into recesses shown at 51, 52, 53, in a spacer 56 and in the conductive metal parts having flat the surfaces at 28, 30 and 32, 33. The multi-contact bridging adapters have the ability to slide within the recesses in order to accommodate the expansions and contractions which occur responsive to temperature changes.

A thin, finned copper conductor 55 is fitted over each sliding bridging adapter 48–50 to insure a good electrical contact with the internal walls of recesses 51–53. The cup-shaped spacer 56 intervenes between bridging adapters 48 and 49 in order to provide space for receiving a universal connector 62. A threaded joint stud 54 fits into a threaded hole 54*a* in bushing 40 and into a threaded hole 54*b* in bridging adapter 48 in order to hold them together as a single unit. A threaded stem 60 on the spacer 56 fits into a threaded opening 61 on the multi-contact bridging adapter 48.

Figure 3:
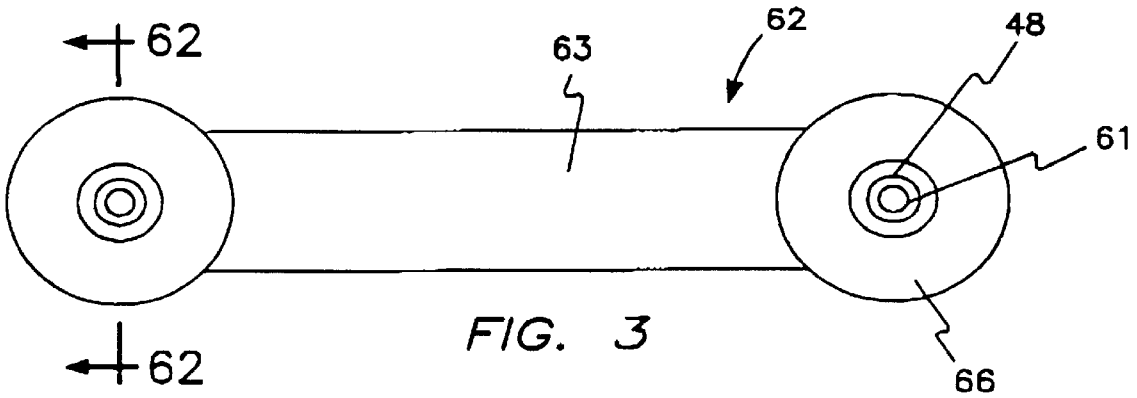
FIG. 3 is a perspective view of a universal connector in the form of a bus bar and associated parts for interconnecting two of the inventive connectors of FIG. 1.

Means are provided to interconnect several of the inventive connectors via a universal connector 62 including conductive bus bar 63 (FIG. 3). This universal connector 62 is also shown in FIG. 1 which is a cross section taken along line 62—62 (FIG. 3). More particularly, the connector 62 is a copper bus bar encased in a plastic (preferably epoxy) covering 64. The opposite ends of the bus bar are formed into a circular washer-like member 66 which fits between the flat surface 30 of adapter bushing 40 and surface 28 of housing entrance 24 in order to provide an access to the power appearing at the inventive connector 22. The copper washer 66 has a center hole 68 to receive and pass threaded stem 60 on spacer cup 56. In order to make a good electrical connection, the copper washer shaped end 66 of the bus bar is captured between the bottom of cup 56 and the multi-contact bridging adapter 49 which is threaded onto stem 60. The elastomer gaskets 36, 37 seal the adapter bushing 40, universal connector 62, and housing entrances 24. Hence, the power. introduced via adapter bushing 40, for example, is distributed to two or more of the inventive connectors 22 via the conductive bar 63.

The point is that many different configurations may be accommodated by selecting the proper parts and adapters.

The connector housing 20 may be made in three parts 72, 74, 76 which are joined in any suitable manner as by cement or heat bonding to provide a single waterproof housing or molded as a single piece. Here the internal parts may be inserted into the housing parts before they are bonded together or encapsulated during the molding operation. At the entrance 26, an end metal contact piece 78 contains the recess 53 in which the multi-contact bridging adapter 50 slides. Any suitable device (such as a metal contact piece) slides into chamber 80 in housing part 74 where the contact piece is bolted to the end piece 78, as shown at 82.

Centrally located in the housing is a tulip jack in the form of a cylindrical member 84 which is made of a resilient metal having spring qualities. A number of elongated fingers are separated by slits 86 formed along a length of the cylinder 84. Preferably, there are six such fingers. A circular spring 88 surrounds the fingers in the cylinder 84. Together, the fingers and circular springs 88 form a jack insuring a good contact pressure acting upon a plug (not shown) to be slipped into the center of the tulip jack formed by cylinder 84.

After the various parts 78–88 are assembled, either the housing is molded over the parts; or, the housing parts 72–76 are bonded together, depending upon the ease and cost of construction.

The chamber 83 in housing part 72 is also adapted to receive any of many suitable devices which might be used with the inventive connector. More particularly, an opening 89 in an end plate 90 closing open end 21 provides an entrance for anything which may be appropriate at a particular installation. Usually, four bolts (as shown at 92) attach closure plate 90 (FIG. 2) to the housing part 72. These bolts enable the inventive connector to be mounted on a rigid surface 94. A circumferential step may be formed at the entrance of housing part 72 in order to facilitate a centering and sealing of an end cap 90 as it is mounted on the housing part 72, thereby closing chamber 83

Figure 5:
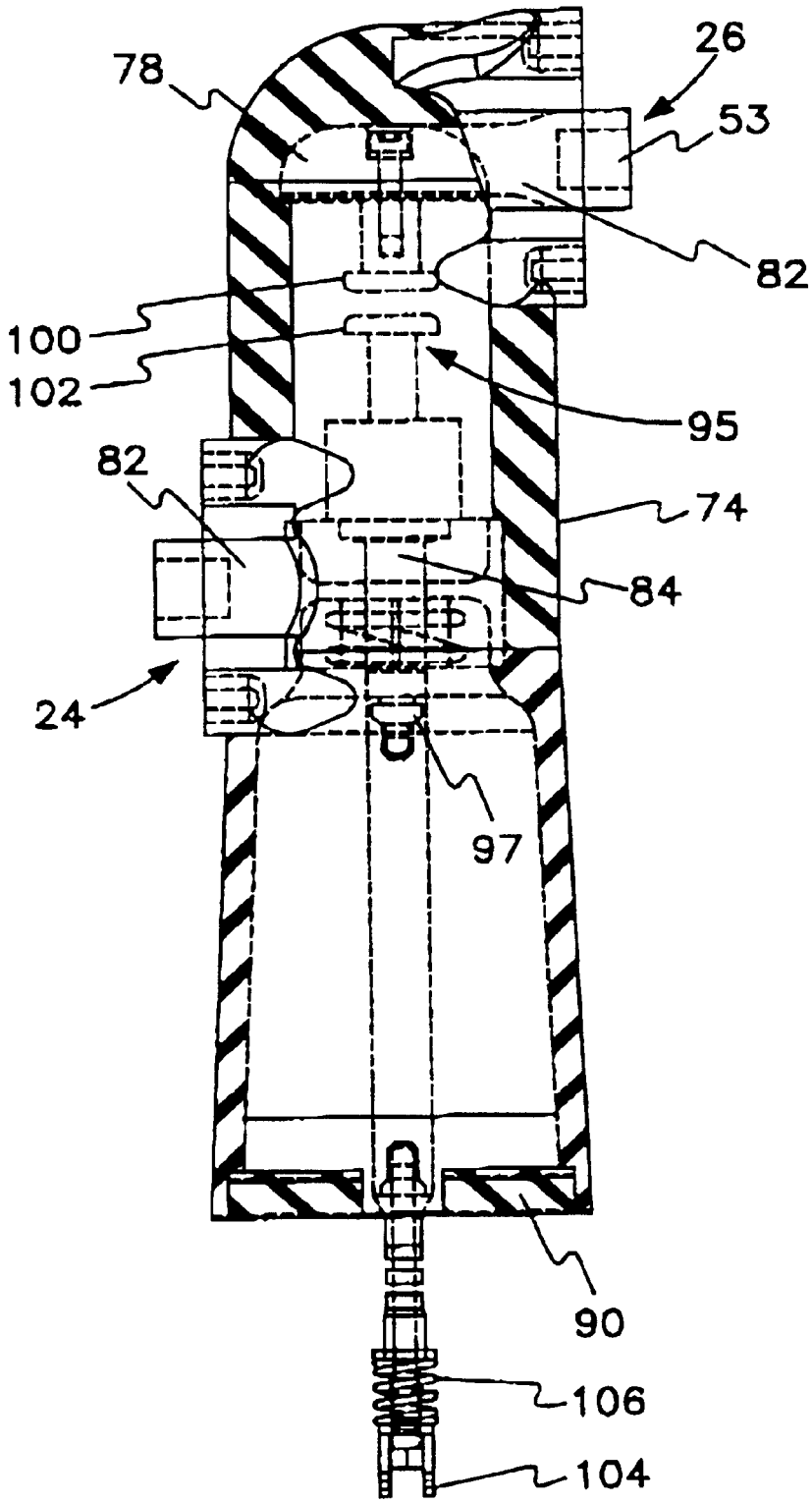
FIG. 5 illustrates one use by showing the housing used in connection with a vacuum interrupter.

The space inside housing may contain any suitable devices, such as: switches, transformers, fuses, transducers, and the like. By way of example, FIG. 5 shows the housing as containing a vacuum interrupter 95. A vacuum interrupter 95 is a commercially available part that can act as a fuse or circuit breaker during overload conditions.

At its lower end, the vacuum interrupter may have a plug 97 which fits into the tulip jack 84 in order to make an electrical contact. Hence, the device inside chamber 80 may be electrically connected to the conductive metal part 82.

In the particular example shown in FIG. 5, the vacuum interrupter 95 has a stationary contact 100 connected through conductive members 78, 53, 50 to bushing 46. A moving contact 102 is connected through jack 84 and parts 82, 52, 49, 56 (FIG. 1) and 48 to bushing 40. A suitable drive rod 104 extends through the opening 89 in bottom plate 90. A return spring 106 enables the rod 104 to assume a desired position under control of any suitable means (not shown) in order to open or close the contacts 100, 102, thereby completing or interrupting a circuit between entrances 24 and 26.

Figure 4:
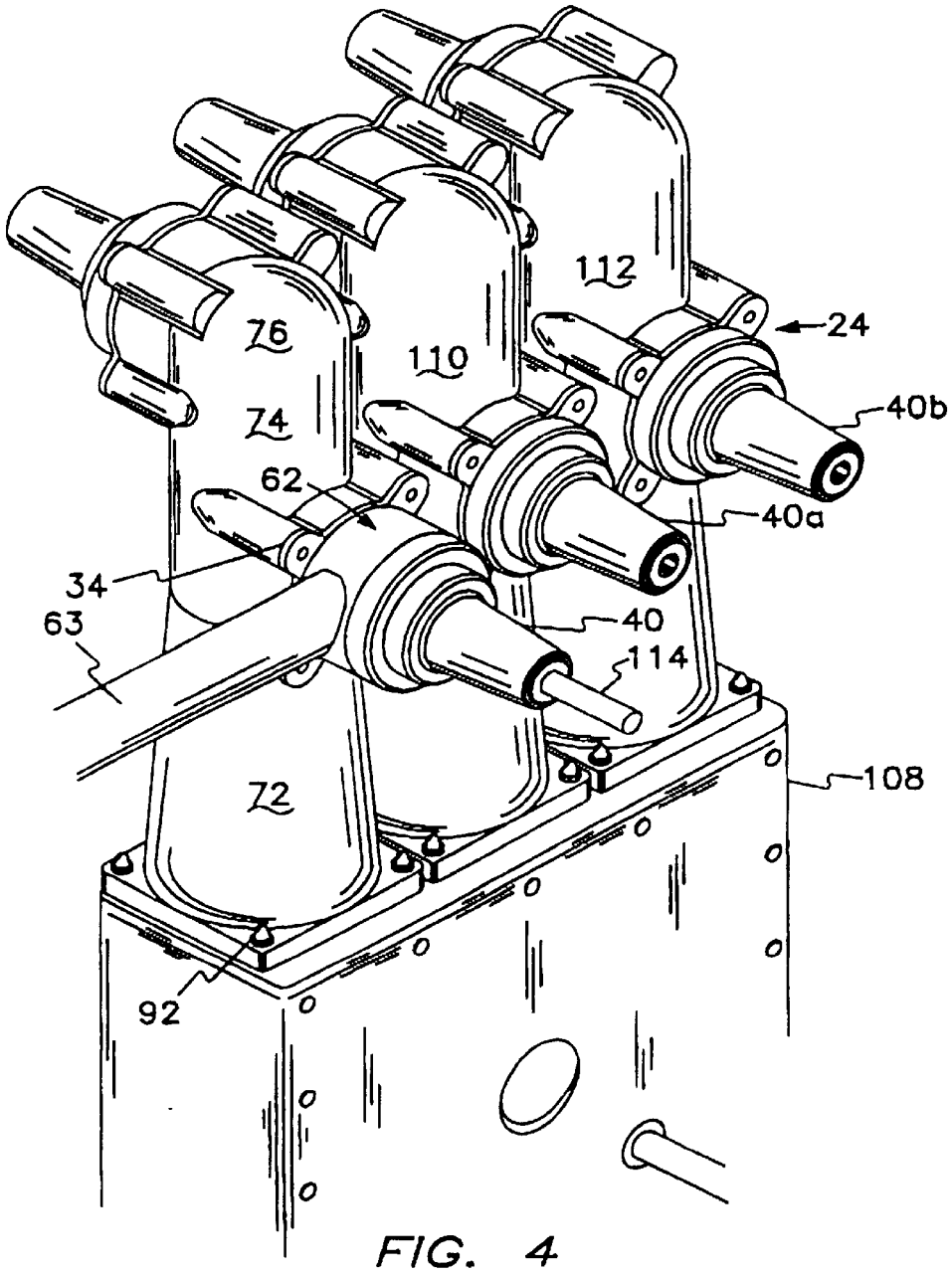
FIG. 4 is a perspective view of three of the inventive connectors, and of a bus bar in place for interconnecting neighboring connectors.

FIG. 4 shows an exemplary installation where a box 108 represents any suitable fixed device. Perhaps it is a transformer. Three of the inventive connectors 74, 110, 112 are attached to the box 108. A flexible power cable (not shown) may be connected at 114 to adapter bushing 40 in order to distribute power to any other suitable location. Still, other flexible cables (not shown) may be connected to adapter bushings 40*a* and 40*b* in order to deliver power to other locations.

In addition, the bus bar 63 of universal connector 62 may carry power to another of the inventive connectors (not shown). The opposite end of bus bar 63 is coupled in a similar manner to another adapter bushing on still another inventive connector (not shown) or to another suitable device.

Figure 6:
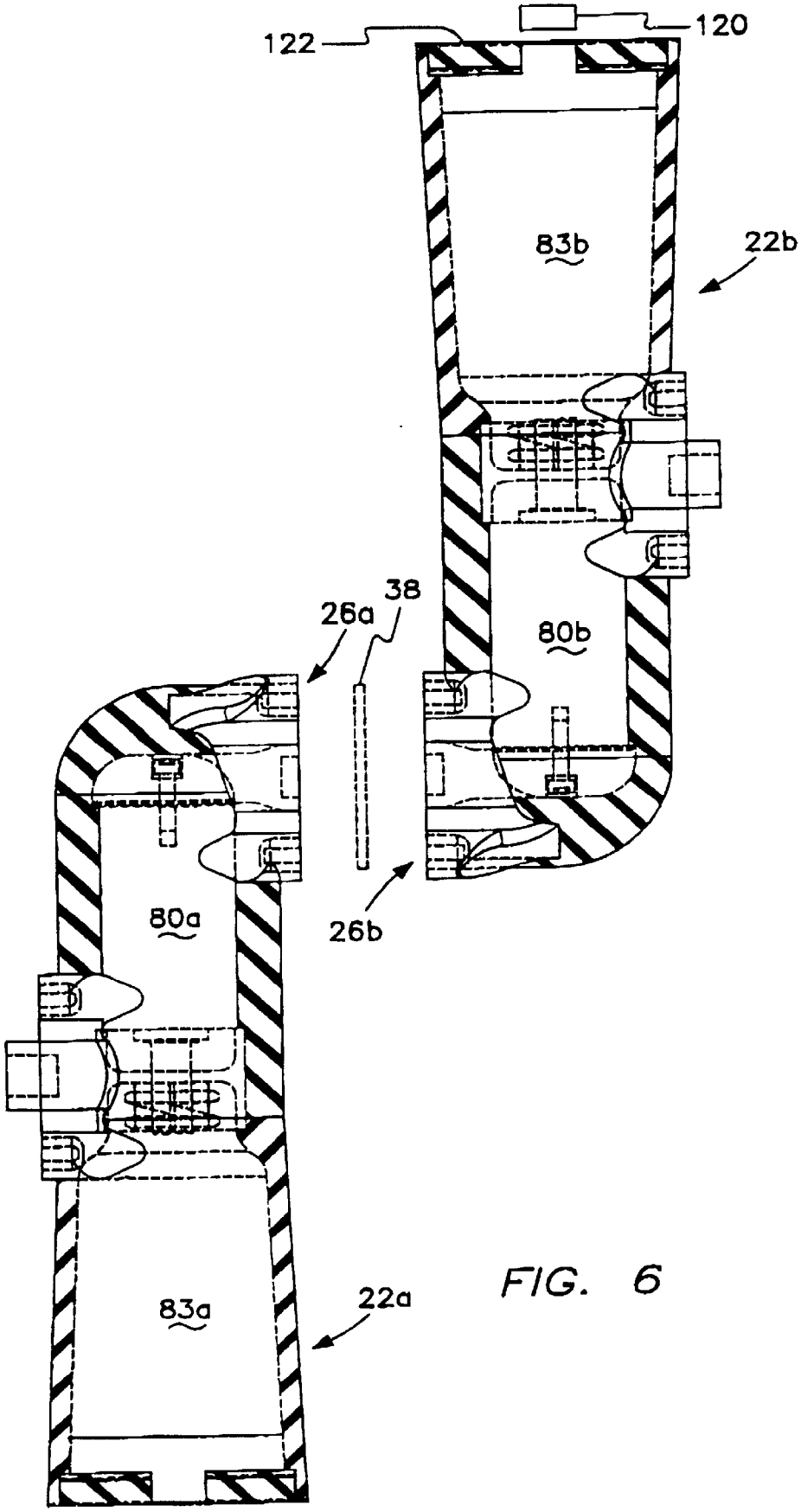
FIG. 6 illustrates how two of the inventive connectors may be joined end-to-end in order to provide an exemplary unitary configuration.
Figure 7:
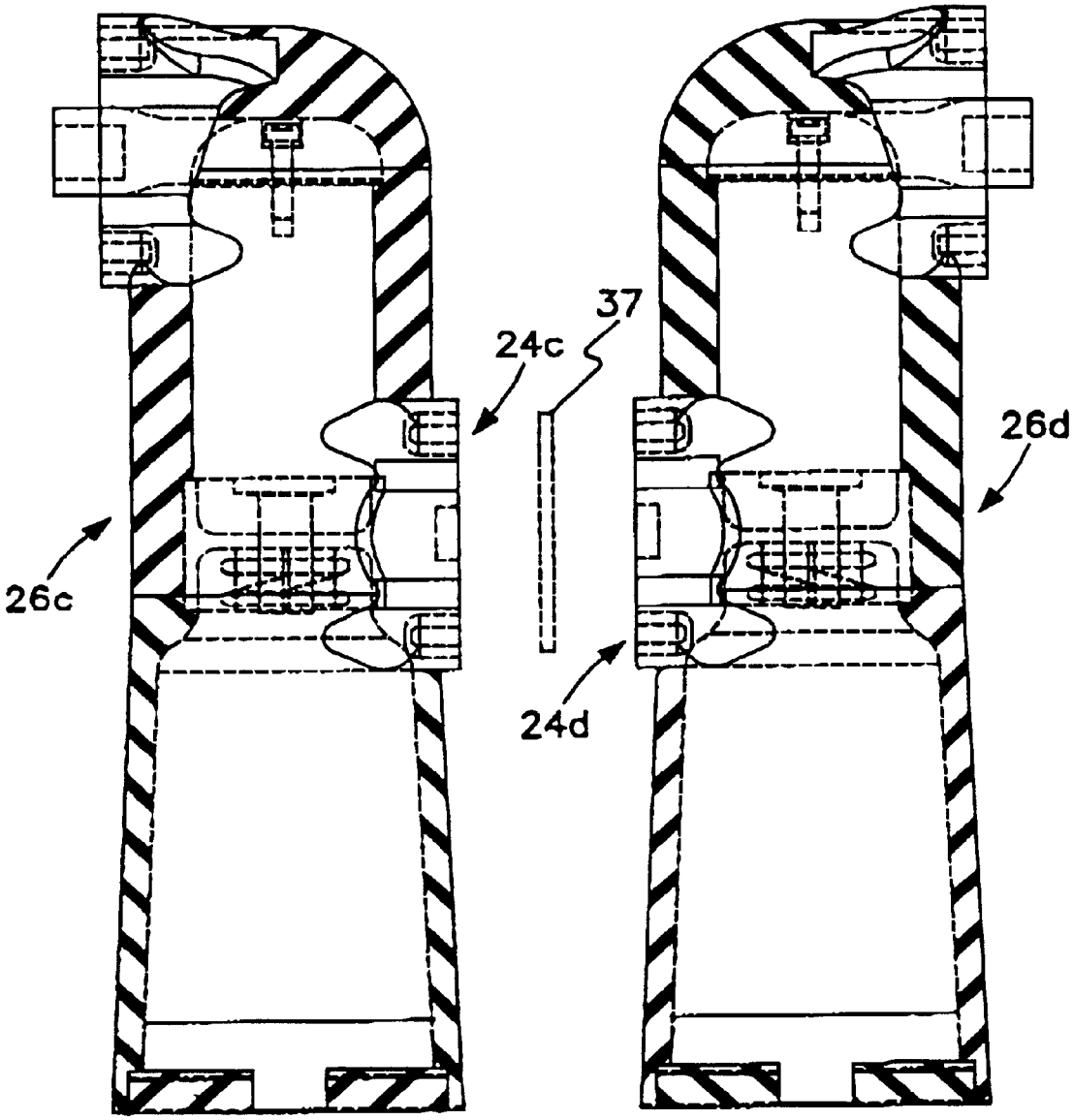
FIG. 7 illustrates how two of the inventive connectors may be joined back-to-back in order to accommodate another exemplary unitary configuration.

A plurality of the universal connectors may be stacked in order to provide for unique requirements. For example, FIG. 6 shows two of the connectors 26*a*, 26*b* stacked end-to-end by being bolted together at the entrances 26*a*, 26*b* with the elastomeric gasket between them. FIG. 7 shows two of the connectors stacked back-to-back by being bolted together at the entrances 26*c*, 26*d* with the elastomeric gasket 37 between them.

By expanding this principle, it is possible to combine many different connectors in many different orientations. For example, three of the connectors may be joined in order to form both end-to-end and back-to-back configurations. The connector housings may be attached with their elongation axis at right angles to each other so that cables may be joined even though they are incoming from north, east, west, and south, or from overhead, two sides, and below. There are many possibilities.

Another reason for stacking connector housings is to combine various pieces of equipment to fit unique needs at specific locations. For example, chamber or space 80*a* (FIG. 6) might contain a vacuum interrupter. Chamber or space 83b might contain a re-closure or thermal switch that shuts off power when there is an overload. A re-closure switch might open a circuit when there is a swinging short and two power lines momentarily touch each other, re-closing the circuit when they swing apart. A thermal switch in chamber 83*b* would open the circuit when there is abnormal heat, as when a motor stops turning, in which case a manual reset button or other control device 120 may be provided on the upper surface 122 of connector 22*b*.

The chamber or space 80*b* may contain a burn-out fuse which would insure that power is not restored until something is fixed. An example of this might be a fan which shuts down in case a fire trips a thermal switch. If the fire dies down and the thermal switch re-closes, the fan could come on and rekindle the fire. A fuse which burns out would prevent such a restart.

Again, the possible uses of the connectors containing extra equipment are almost endless. The point is that any suitable equipment may be selected and combined in the housing on a basis of the unique requirements at a specific location.

Those familiar with the power distribution art will readily perceive various modifications that fall within the spirit and scope of the invention. Therefore, the appended claims are to be construed to cover all equivalent structures.

The claimed invention is:

1. An electrical power connector for connecting a flexible power cable to a fixed device, said connector comprising:

a housing made of insulating material and having an open end and at least one entrance remote from said open end, means associated with said open end for securing said insulated housing to a fixed device, a conductive part at said entrance of said housing, said conductive part having a recess therein, a bushing adapted to be attached to the entrance of said housing for making an electrical connection between said conductive part and an external flexible cable, a bridging adapter for electrically connecting said flexible cable to said conductive part, said bridging adapter being adapted for sliding movement in said recess when said bushing is attached to said entrance in order to accommodate expansion and contraction caused by temperature changes; and means for completing an electrical connection between said conductive part at said entrance and another part associated with said fixed device.

2. The power connector of claim 1 wherein there are at least two of said entrances to said housing with a conductive metal part in each entrance and with a bushing connected to each of said entrances.

3. The power connector of claim 1 wherein there are a plurality of said electrical power connectors and means comprising a conductive bus bar for interconnecting a pair of said connectors, said conductive bus bar being connected between said bushing and said metal part on each of said pair of connectors.

4. The electrical power connector of claim 1 wherein there are a plurality of said entrances and said metal parts with an associated one of said metal parts at each entrance, one of said entrances being centrally located in said housing, said metal part at said central entrance having a tulip jack connected thereto, said jack being in the form of a cylinder of fingers for receiving a plug on an associated part enclosed within said housing.

5. The elctrical power connector of claim 4 wherein said associated part is selected from the group consisting of switches, transformers, fuses and transducers.

6. The electrical power connector of claim 1 wherein a thin device made of conductive material and having fins surrounds the bridging adapter to insure good electrical contact between said bridging adapter and said recess as said bridging contact slides in said recess.

7. A high voltage power connector comprising a plurality of bushings, a multi-chamber, elongated housing made of a corrosion resistant and electrically insulating material, one end of said elongated housing having means for attaching said housing to a fixed surface, each of an opposite end and a central section of said elongated housing having an entrance containing a conductive part for making an electrical connection with an associated one of said bushings, each of said conductive parts having a recess with a bridging adapter for making an electrical contact between said conductive part and its associated bushing, said bridging adapter being adapted for sliding in said recess when said bushings are attached to said housing for accommodating expansions/contractions caused by temperature changes, and a jack formed in association with said conductive part at one of said entrances, said jack being adapted to receive a plug of an object inserted into said housing.

8. The high voltage connector of claim 7 and means for electrically inter-connecting a plurality of said housings by a bus bar coupled between an associated one of said conductive parts and its associated bushing on each of said housings.

9. The high voltage connector of claim 8 and a cup-shaped spacer member having a stem extending through an opening in said bus bar, one of said bridging adapters being coupled to said stem for capturing said bus bar between said cup-shaped spacer member and said one bridging adapter, said one bridging adapter sliding in a recess on one of said conductive parts, and a second bridging adapter associated with said associated bushing and sliding in said cup of said cup-shaped spacer member.

10. The high voltage connector of claim 7 and a stacked plurality of said housings joined together by attaching an entrance on one of said housings to an entrance on another of said housings.

11. The connector of claim 10 wherein said stacked housings are joined at different angles relative to each other in order to accept wires incoming from different directions.

12. The high voltage connector of claim 11 including equipment in at least some of said chambers of said housing, said equipment being selected from the group consisting of switches, transformers, fuses and transducers.

13. An electrical connector for joining two devices where there are temperature caused expansions/contractions, said connector comprising first conductive means having a joining stud attached thereto, a bridging adapter attached to said joining stud, second conductive means having a recess in which said bridging connector may slide, said bridging adapter being adapted for sliding in said recess when said first conductive means is attached to said second conductive means for accommodating expansions/contractions and a thin resilient metal part removably fitting over said adapter for making an electrical contact between said adapter and an interior wall of said recess.

14. An electrical connector for joining two devices where there are temperature caused expansions/contractions, said connector comprising first conductive means having a joining stud attached thereto, a multi-contact bridging adapter attached to said joining stud, second conductive means having a recess in which said multi-contact bridging connector may slide, and a thin resilient metal part fitting over said adapter for making an electrical contact between said adapter and an interior wall of said recess wherein said conductive means is a cup-shaped member having a stem, said recess being formed at the interior of said cup shape, a second multi-contact adapter attached to said stem of said cup-shaped member, second means having a recess therein for slidingly receiving said second multi-contact adapter and a thin resilient metal part fitting over said second multi-contact adapter for making an electrical contact between said second adapter and the interior wall of said cup shape.

15. The connector of claim 13 wherein said first conductive means is a bushing and said second conductive member is an electrical conductive part at an entrance to a connector housing.

16. An electrical connector for joining two devices where there are temperature caused expansions/contractions, said connector comprising first conductive means having a joining stud attached thereto, a multi-contact bridging adapter attached to said joining stud, second conductive means having a recess in which said multi-contact bridging connector may slide, and a thin resilient metal part fitting over said adapter for making an electrical contact between said adapter and an interior wall of said recess; wherein said first conductive means is a bushing and said second conductive means is a cup-shaped spacer, and a busbar, said spacer providing a location for receiving said busbar in order to take power from said bushing.

17. An electrical power connector for connecting a flexible power cable to a fixed device, said connector comprising:

a housing made of insulating material and having an open end and at least one entrance remote from said open end, means associated with said open end for securing said insulated housing to a fixed device;

a conductive part at said entrance of said housing, said conductive part having a recess therein;

a bushing adapted to be attached to the entrance of said housing for making an electrical connection between said conductive part and a flexible cable;

a bridging adapter for electrically connecting said conductive part with said bushing, said bridging adapter being adapted for sliding movement in said recess when said bushing is attached to said entrance in order to accommodate expansion and contraction caused by temperature changes;

an elastomeric gasket disposed between said entrance of said housing and said bushing; and a means for completing an electrical connection between said conductive part and said fixed device.

18. An electrical power connector for connecting a flexible power cable to a fixed device, said connector comprising:

a housing made of insulating material and having an open end and at least one entrance remote from said open end, means associated with said open end for securing said insulated housing to a fixed device;

a conductive part at said entrance of said housing, said conductive part having a recess therein;

a bushing adapted to be attached to the entrance of said housing for making an electrical connection between said conductive part and an external flexible cable;

an elastomeric gasket disposed between the entrance of said housing and said bushing;

a bridging adapter for electrically connecting said bushing to said conductive part; and a means for completing an electrical connection between said conductive part and said fixed device.

19. An electrical power connector for connecting a flexible power cable to a fixed device, said connector comprising:

a housing made of insulating material and having an open end and at least one entrance remote from said open end, means associated with said open end for securing said insulated housing to a fixed device, said housing having at least one chamber suitable for accommodating other devices;

a conductive part at said entrance of said housing, said conductive part having a recess therein;

a bushing adapted to be attached to the entrance of said housing for making an electrical connection between said conductive part and an external flexible cable;

a bridging adapter for electrically connecting said bushing to said conductive part;

a means for completing an electrical connection between said conductive part and said fixed device; and equipment disposed in said at least one of said chamber of said housing, said equipment being selected from the group consisting of switches, transformers, fuses and transducers.

20. An electrical power connector for connecting a flexible power cable to a fixed device, said connector comprising:

a housing made of insulating material and having an open end and at least one entrance remote from said open end, means associated with said open end for securing said insulated housing to a fixed device, said housing having at least one chamber suitable for accommodating other devices;

a conductive part at said entrance of said housing, said conductive part having a recess therein;

a bushing adapted to be attached to the entrance of said housing for making an electrical connection between said conductive part and an external flexible cable;

a means for completing an electrical connection between said conductive part and said fixed device; and a bridging adapter for electrically connecting said bushing to said conductive part, said bridging adapter being adapted for sliding movement in said recess when said bushing is attached to said entrance in order to accommodate expansion and contraction caused by temperature changes;

an elastomeric gasket disposed between said entrance of said housing and said bushing;

a jack operatively associated with said conductive part, said jack being adapted to receive a plug of an object inserted into said housing.

21. The electrical connector of claim 20 further comprising a thin resilient metal part removably fitting over said bridging adapter for making an electrical contact between said adapter and said conductive part.

22. The electrical connector of claim 20 further comprising equipment disposed in said at least one chamber, said equipment being selected from the group consisting of switches, transformers, fuses and transducers.

* * * * *